US010449398B2

(12) United States Patent
Bergman

(10) Patent No.: US 10,449,398 B2
(45) Date of Patent: Oct. 22, 2019

(54) EARLESS FILTER MASK

(71) Applicant: Marleen Myers Bergman, Houston, TX (US)

(72) Inventor: Marleen Myers Bergman, Houston, TX (US)

( * ) Notice: Subject to any disclaimer, the term of this patent is extended or adjusted under 35 U.S.C. 154(b) by 612 days.

(21) Appl. No.: 15/271,688

(22) Filed: Sep. 21, 2016

(65) Prior Publication Data

US 2018/0078797 A1 Mar. 22, 2018

(51) Int. Cl.

| | |
|---|---|
| ***A62B 23/00*** | (2006.01) |
| ***A62B 18/08*** | (2006.01) |
| ***A62B 23/02*** | (2006.01) |
| ***A41D 13/11*** | (2006.01) |

(52) U.S. Cl.

CPC ..... *A62B 18/084* (2013.01); *A41D 13/11* (2013.01); *A62B 23/025* (2013.01)

(58) Field of Classification Search

CPC ... A62B 23/025; A62B 18/084; A62B 18/025; A41D 13/11; A41D 13/1161

USPC ..... 128/206.19

See application file for complete search history.

(56) References Cited

U.S. PATENT DOCUMENTS

| | | | | |
|---|---|---|---|---|
| 695,403 | A * | 3/1902 | Longden | A41D 13/1161 128/206.12 |
| 2,237,305 | A * | 4/1941 | Heimann | A41D 13/1161 128/206.13 |
| 2,281,744 | A * | 5/1942 | Brunner | A41D 13/1161 128/206.13 |
| 2,634,725 | A * | 4/1953 | Lo Presti | A41D 13/11 128/206.19 |
| 4,662,005 | A * | 5/1987 | Grier-Idris | A41D 13/1115 128/206.19 |
| 6,338,340 | B1 | 1/2002 | Finch et al. | |
| D820,434 | S | 6/2018 | Bergman | |
| 2003/0217751 | A1* | 11/2003 | Patrick | A41D 13/1161 128/205.27 |
| 2005/0051172 | A1 | 3/2005 | Lee | |
| 2014/0202469 | A1* | 7/2014 | Smaller | A62B 18/025 128/863 |

(Continued)

FOREIGN PATENT DOCUMENTS

WO 2018057491 A1 3/2018

OTHER PUBLICATIONS

International Search Report of the International Searching Authority (USPTO) for international application PCT/US2017/52187 dated Nov. 24, 2017.

(Continued)

*Primary Examiner* — Bradley H Philips

(74) *Attorney, Agent, or Firm* — Basil M. Angelo; Angelo IP

(57) ABSTRACT

An earless filter mask includes an inner fabric layer, a filter layer, an outer fabric layer, a plurality of buttons, an exhalation valve, and a conforming band. The conforming band is sewn into an upper and a lower edge of the mask through in-seam sleeves with a first exposed portion extending beyond a first tapered end of the mask and a second exposed portion extending beyond a second tapered end of the mask. The conforming band conforms the mask to a shape of a wearer's face and a first tapered end of the mask is removably connected to a second tapered end of the mask at a nape of the wearer's neck.

11 Claims, 8 Drawing Sheets

(56) References Cited

U.S. PATENT DOCUMENTS

2018/0078797 A1 3/2018 Bergman

OTHER PUBLICATIONS

Video entitled "3M™ Half Facepiece Respirator 7500 Series Training Video—Full" obtained from https://youtu.be/mlWyMPFwEI8.
Video entitled "Respro Techno Anti-Pollution Mask Review" obtained from https://youtu.be/SO7TKi7MVz8.
Written Opinion of the International Searching Authority (USPTO) for international application PCT/US2017/52187 dated Nov. 24, 2017.

* cited by examiner

EARLESS FILTER MASK

BACKGROUND OF THE INVENTION

Air pollution occurs when undesirable gases or particles are introduced into the air that humans breathe. Common pollutants include carbon monoxide, sulfur dioxide, nitrogen oxides, ground-level ozone, lead, sand, dust particles, and other particulate matter. In large cities around the world, man-made air pollution and pollution related ailments tend to increase with population density. Common pollution related ailments include respiratory diseases, cardiovascular diseases, cancers, adverse pregnancy outcomes, and even death. Conventional pollution masks seek to protect the wearer from inhaling certain gases or particles in polluted areas.

BRIEF SUMMARY OF THE INVENTION

According to one aspect of one or more embodiments of the present invention, an earless filter mask includes an inner fabric layer, a filter layer, an outer fabric layer, a plurality of buttons, an exhalation valve, and a conforming band. The conforming band is sewn into an upper and a lower edge of the mask through in-seam sleeves with a first exposed portion extending beyond a first tapered end of the mask and a second exposed portion extending beyond a second tapered end of the mask. The conforming band conforms the mask to a shape of a wearer's face and a first tapered end of the mask is removably connected to a second tapered end of the mask at a nape of the wearer's neck.

According to one aspect of one or more embodiments of the present invention, a method of filtering air with an earless filter mask includes placing the earless filter mask over a wearer's nose and mouth, conforming the earless filter mask to a shape of the wearer's face, and connecting a first tapered end of the earless filter mask to a second tapered end of the earless filter mask at a nape of the wearer's neck.

Other aspects of the present invention will be apparent from the following description and claims.

DETAILED DESCRIPTION OF THE INVENTION

Figure 1:
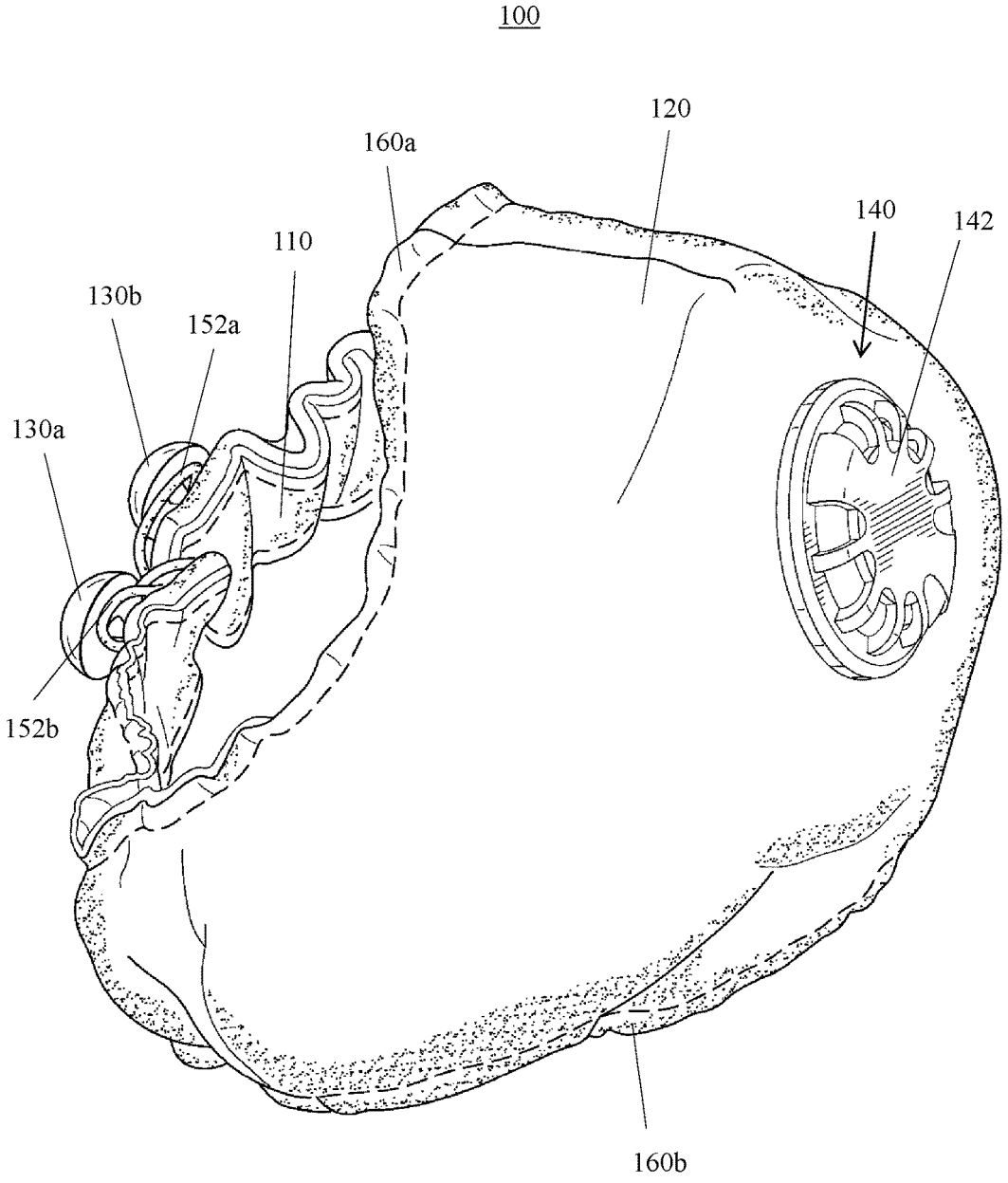
FIG. 1 shows a perspective view of an earless filter mask in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a detailed understanding of the present invention. In other instances, well-known features to one of ordinary skill in the art are not described to avoid obscuring the description of the present invention.

Conventional pollution masks suffer from a number of functional, ergonomic, and aesthetic issues that prevent their widespread adoption and use. These pollution masks are typically made of a bulky and non-breathable material that is poorly fitted to a wearer's face by pulling elastic loops around the wearer's ears. In addition to being uncomfortable to wear, these pollution masks fail to conform completely to the contours of the wearer's face, thereby allowing for the unintended inhalation of polluted air. Some commercially available masks include a metal bracket that the wearer may pinch over the bridge of the nose to help hold the mask in place. However, even with these brackets, these masks do not conform completely and pollution may still enter the interior breathing area of the mask.

Conventional pollution masks are typically made of a non-breathable material that poses a number of issues including the build-up of moisture on the interior facing portion of the mask and a warm sensation for the wearer that makes long term wear unpleasant. While non-breathable, fine particulate matter may still traverse the barrier of the non-breathable material and enter the interior breathing area of the mask. For these and other reasons, tolerance of conventional pollution masks is very low and most wearers prefer not to wear them for extended periods of time. Moreover, conventional pollution masks lack aesthetic appeal and are not appealing to women. For example conventional pollution masks typically have a masculine appearance, interfere with the wearing of earrings, and do not match well with a female ensemble.

Accordingly, in one or more embodiments of the present invention, an earless filter mask provides a small profile mask made of a soft breathable material that conforms to the shape of a wearer's face, is comfortable to wear for extended periods of time, prevents the unintentional inhalation of polluted air, and is aesthetically pleasing. In one or more embodiments of the present invention, an earless filter mask may include a multi-layer construction that wraps around and conforms to the shape of the wearer's face and tapers down in size to fasten at the nape of the wearer's neck below the ears, without loops that are secured to the ears. A filter layer may prevent the inhalation of polluted air through the fabric layers of the mask, while remaining constructed of breathable material, and a single exhalation valve may allow a wearer to breathe out while wearing the mask without the buildup of gases within the interior breathing area of the mask or a warm sensation for the wearer.

FIG. 1 shows a perspective view of an earless filter mask 100 in accordance with one or more embodiments of the present invention. Earless filter mask 100 may include an inner fabric layer 110, a filter layer (not shown), an outer fabric layer 120, a plurality of buttons 130*a* and 130*b*, and an exhalation valve 140 (outer portion 142 shown). A conforming band (not independently illustrated) may be sewn into an upper and a lower edge of mask 100 through in-seam sleeves 160*a* and 160*b* with a first exposed portion 152*a* extending beyond a first tapered end of mask 100 and a second exposed portion 152*b* extending beyond a second tapered end of mask 100. The conforming band (not independently illustrated) may conform mask 100 to a shape of the wearer's face (not shown) and a first tapered end of mask 100 may be removably connected to a second tapered end of mask 100 at the nape of the wearer's neck (not shown) below the wearer's ears (not shown). For example, first exposed portion 152*a* of the conforming band that extends beyond the first tapered end of mask 100 may be pulled around button 130*b* disposed on the opposing tapered end of mask 100. Similarly, second exposed portion 152*b* of the conforming band that extends beyond the second tapered end of mask 100 may be pulled around button 130*a* disposed on the opposing tapered end of mask 100, thereby securing mask 100 around the nape of the wearer's neck (not shown).

In certain embodiments, mask 100 may include a decorative layer (not shown), such as, for example, lace accoutrements, disposed on the outer facing surface of outer fabric layer 120, that may be aesthetically pleasing and coordinated with the wearer's ensemble. In certain embodiments, secondary pieces of fabric such as, for example, a coordinating scarf (not shown) with buttonholes may be attached to mask 100 by buttoning over buttons 130*a* and 130*b*. For example, a secondary piece of fabric (not shown) may be attached to buttons 130*a* and 130*b* at the tapered ends of mask 100, and then crossed at the back to then wrap from the back of neck to the front of the neck to tie at the front of the neck, thereby covering the neck. Alternatively, a secondary piece of fabric (not shown) may be crossed at the back of the neck and brought up the sides of the face, over or behind the ears, to tie on the top of the head or on one side of the head as a decorative feature. Larger pieces of secondary fabric may also be attached to mask 100, crossed and wrapped to cover the hair and chest area entirely, providing a modesty cover for religious or other purposes.

Figure 2:
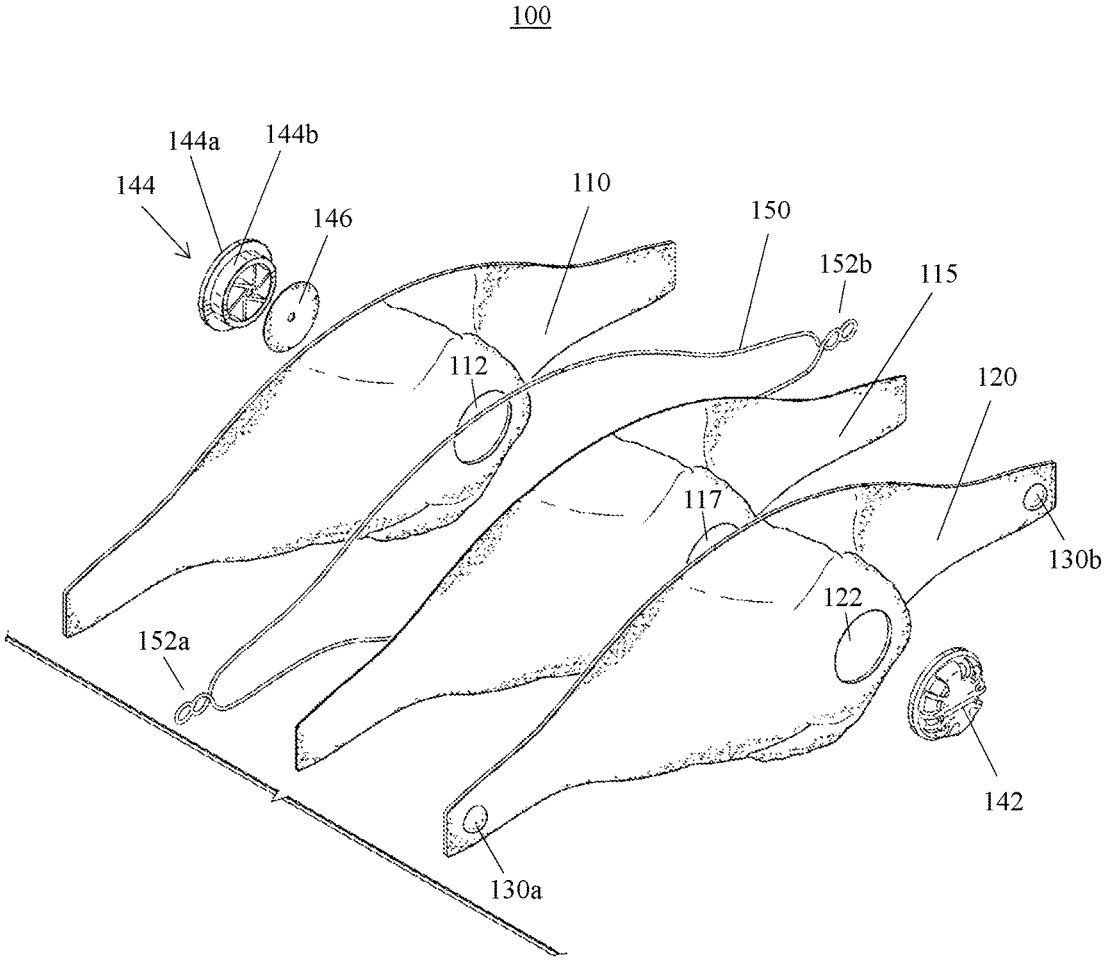
FIG. 2 shows an exploded perspective view of an earless filter mask in accordance with one or more embodiments of the present invention.

FIG. 2 shows an exploded perspective view of an earless filter mask 100 in accordance with one or more embodiments of the present invention. Earless filter mask 100 may include an inner fabric layer 110 having a first tapered end (left side), a protruding portion (center), and a second tapered end (right side). An interior facing portion (not shown) of inner fabric layer 110 may be in contact with a wearer's face (not shown) when mask 100 is worn. In certain embodiments, inner fabric layer 110 may be composed of soft and breathable cotton or cotton blended fabric material. In other embodiments, inner fabric layer 110 may be composed of non-woven fabric. In still other embodiments, inner fabric layer 110 may be composed of synthetic fabric. One of ordinary skill in the art will recognize that other soft and breathable materials may be used in accordance with one or more embodiments of the present invention.

Earless filter mask 100 may also include an outer fabric layer 120. Outer fabric layer 120 may be the exterior facing portion of mask 100 having a first tapered end (left side), a protruding portion (center), and a second tapered end (right side) substantially similar in size and shape to inner fabric layer 110. In certain embodiments, outer fabric layer 120 may be composed of soft and breathable cotton or cotton blended fabric material. In other embodiments, outer fabric layer 120 may be composed of non-woven fabric. In still other embodiments, outer fabric layer 120 may be composed of synthetic fabric. One of ordinary skill in the art will recognize that other soft and breathable materials may be used in accordance with one or more embodiments of the present invention. A plurality of buttons 130*a*, 130*b* may be disposed on an outer facing surface of outer fabric layer 120. In certain embodiments, a first button 130*a* may be disposed on an outer facing portion of a first tapered end of outer fabric layer 120 and a second button 130*b* may be disposed on an outer facing surface of a second tapered end of outer fabric layer 120. The plurality of buttons may be used to secure first 152*a* and second exposed 152*b* portions of a conforming band 150 when mask 100 is worn.

Earless filter mask 100 may also include a filter layer 115. Filter layer 115 may be an interior layer disposed between inner fabric layer 110 and outer fabric layer 120. Filter layer 115 may have a first tapered end (left side), a protruding portion (center), and a second tapered end (right side) that is substantially similar in size and shape to inner fabric layer 110 and outer fabric layer 120. Filter layer 115 may be composed of a material configured to substantially filter out one or more pollutants, while allowing inner fabric layer 110 and outer fabric layer 120 to remain breathable. In certain embodiments, filter layer 115 may be composed of a carbon filter material. In other embodiments, filter layer 115 may be composed of non-woven fabric. In still other embodiments, filter layer 115 may be composed of synthetic fabric. One of ordinary skill in the art will recognize that the type or kind of filter layer may vary based on an application or design in accordance with one or more embodiments of the present invention.

Inner fabric layer 110, filter layer 115, and outer fabric layer 120 may be aligned and sewn together along an upper and a lower edge (not independently illustrated) of mask 100. An upper in-seam sleeve 160*a* may be formed along the upper edge of mask 100 and a lower in-seam sleeve 160*b* may be formed along the lower edge of mask 100, where sleeves 160*a* and 160*b* are configured to receive a conforming band 150. In FIG. 2, conforming band 150 is shown as it may appear once installed in mask 100. In practice, a first end (not independently illustrated) of conforming band 150 may be threaded through one or more of upper and lower in-seam sleeves 160*a* and 160*b* and then connected to a second end (not independently illustrated) such that a first exposed portion 152*a* may be exposed beyond a first tapered end of mask 100 and a second exposed portion 152*b* may be exposed beyond a second tapered end of mask 100. First exposed portion 152*a* may include one or more loops, formed by twisting band 150, that may be used to connect to button 130*b* and second exposed portion 152*b* may include one or more loops, formed by twisting band 150, that may be used to connect to button 130*a*. One of ordinary skill in the art will recognize that the number of loops may vary to accommodate fit and size in accordance with one or more embodiments of the present invention. Conforming band 150 may be composed of a flexible, semi-rigid, and bendable material that provides a limited amount of stretching ability. In certain embodiments, conforming band 150 may be composed of an elastic material. In other embodiments, conforming band 150 may be non-woven fabric. In still other embodiments, conforming band 150 may be synthetic fabric. One of ordinary skill in the art will recognize that other flexible, semi-rigid, and bendable materials may be used in accordance with one or more embodiments of the present invention.

Inner fabric layer 110, filter layer 115, and outer fabric layer 120 may include cutouts 112, 117, and 122 disposed at a location corresponding to the location of the nose and mouth of the wearer (not shown) that are configured to receive an exhalation valve 140 (142, 144, and 146 collectively). Exhalation valve 140 may allow the wearer (not shown) to breathe out while wearing mask 100 without the buildup of gases within the interior breathing area of mask 100. In addition, exhalation valve 140 may minimize moisture buildup inside mask 100 and the associated fogging of eyewear (not shown) while wearing mask 100. Exhalation valve 140 may include an outer facing portion 142 disposed on, or otherwise secured to, an outer facing portion of outer fabric layer 120, around cutout 122 of outer fabric layer 120. Exhalation valve 140 may also include an inner facing portion 144 having a first distal end 144*a* exposed on an interior facing portion of inner fabric layer 110 and a second distal end 144*b* that extends through cutouts 112, 117, and 122 in inner fabric layer 110, filter layer 115, and outer fabric layer 120. Inner facing portion 144 may be removably attached to outer facing portion 142 of exhalation valve 140 with a removable valve flap 146 disposed between inner facing portion 144 and outer facing portion 142. In certain embodiments, valve flap 146 may be composed of a rubber material. In other embodiments, valve flap 146 may be composed of non-woven fabric or material. In still other embodiments, valve flap 146 may be composed of synthetic fabric or material. One of ordinary skill in the art will recognize that other filter materials may be used in accordance with one or more embodiments of the present invention.

Figure 3:
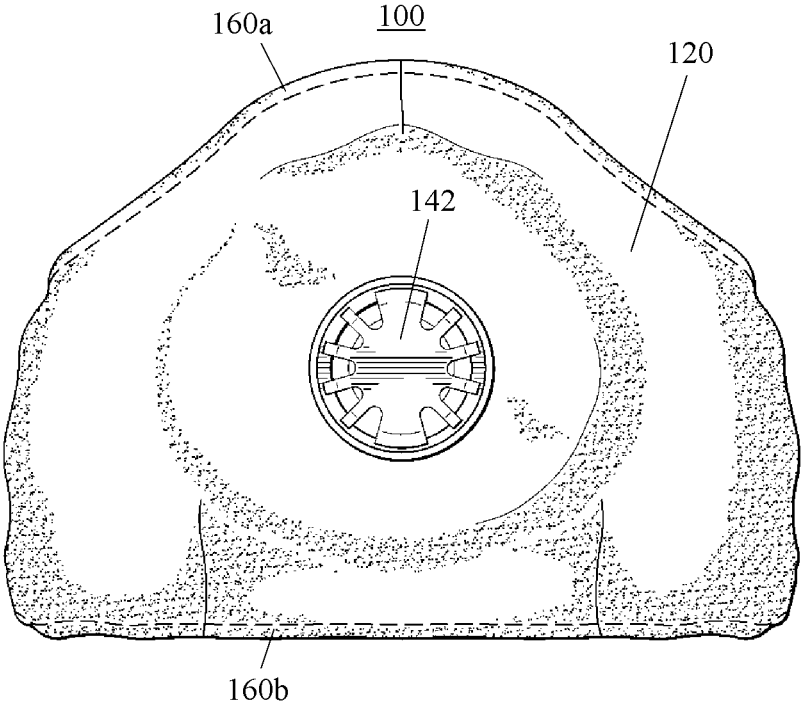
FIG. 3 shows a front elevation view of an earless filter mask in accordance with one or more embodiments of the present invention.

FIG. 3 shows a front elevation view of an earless filter mask 100 in accordance with one or more embodiments of the present invention. From the front elevation view, the protruding portion (center) of mask 100 that covers the wearer's nose and mouth (not shown) is shown. A conforming band (150 of FIG. 2) may be disposed within the upper 160*a* and lower 160*b* in-seam sleeves. The conforming band (150 of FIG. 2) allows mask 100 to conform to the shape of the wearer's face (not shown). The portion of the conforming band (150 of FIG. 2) disposed within upper in-seam sleeve 160*a* allows mask 100 to conform, for example, to the shape of the wearer's face from the bridge of the nose to the cheeks (not shown) and the portion of the conforming band (150 of FIG. 2) disposed within lower in-seam sleeve 160*b* allows mask 100 to conform, for example, to the shape of the wearer's face from the jaw to where the neck meets the jaw (not shown).

Figure 4:
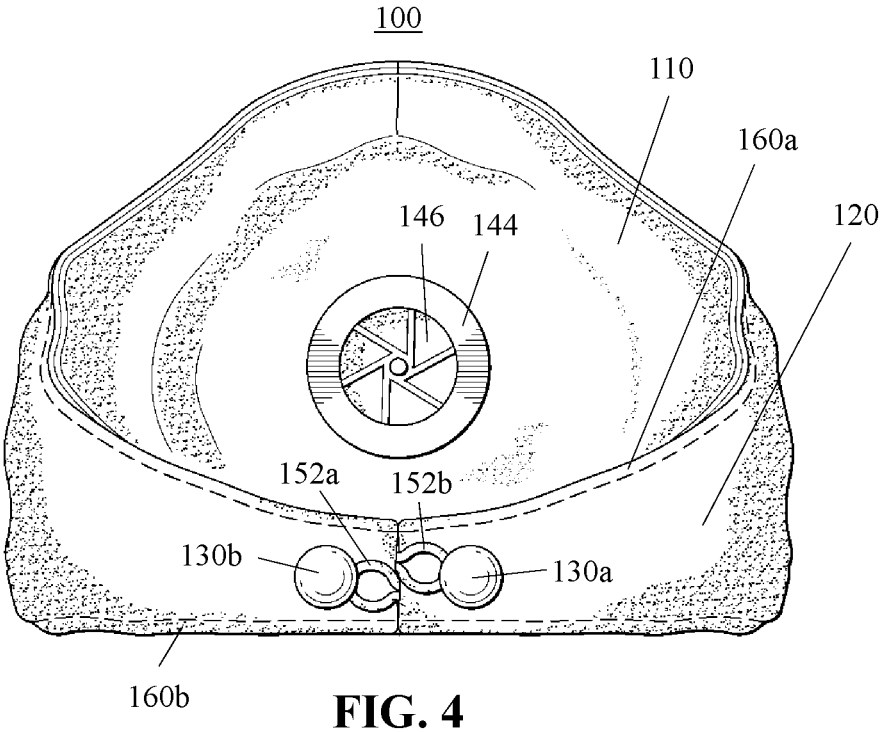
FIG. 4 shows a rear elevation view of an earless filter mask in accordance with one or more embodiments of the present invention.

FIG. 4 shows a rear elevation view of an earless filter mask 100 in accordance with one or more embodiments of the present invention. From the rear elevation view, an interior breathing area of mask 100 is shown. An inner facing portion 144 of exhalation valve 140 and a portion of valve flap 146 are shown. A first tapered end (right tapered side in view) of mask 100 may be connected to a second tapered end (left tapered side in view) of mask 100. For example, a first exposed portion 152*a* of the conforming band (150 of FIG. 2) that extends beyond the first tapered end of mask 100 from in-seam sleeves 160*a* and 160*b* may be secured around button 130*b* disposed on the opposing tapered end of mask 100. Similarly, a second exposed portion 152*b* of the conforming band (150 of FIG. 2) that extends beyond the second tapered end of mask 100 from in-seam sleeves 160*a* and 160*b* may be secured around button 130*a* disposed on the opposing tapered end of mask 100. As discussed above, the conforming band (150 of FIG. 2) allows mask 100 to conform to the shape of the wearer's face (not shown) including around the jaw and neck to the point where the first and second tapered ends of mask 100 are secured to one another at the nape of the wearer's neck (not shown).

Figure 5:
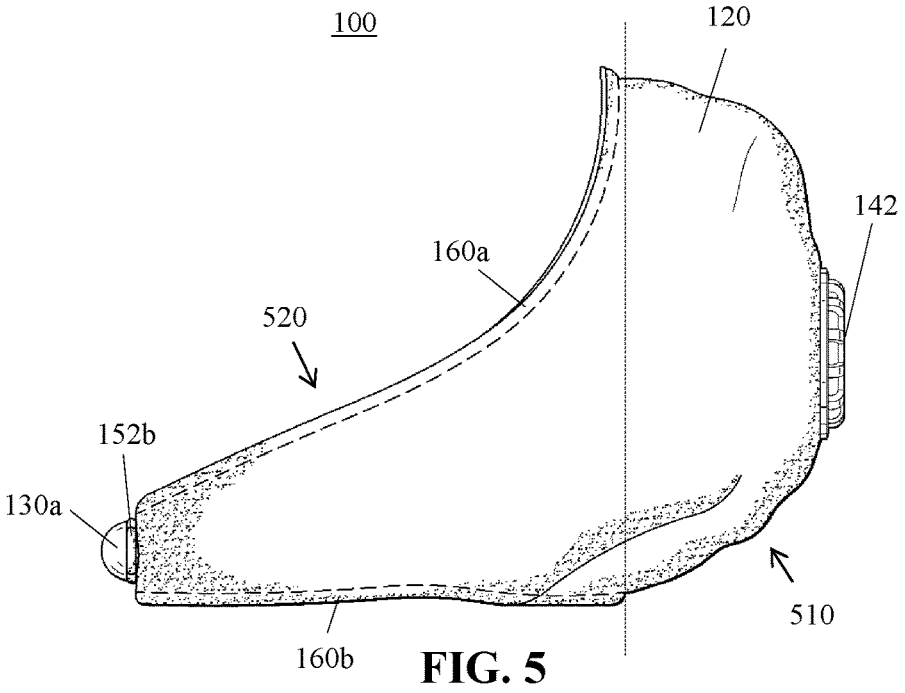
FIG. 5 shows a left side elevation view of an earless filter mask in accordance with one or more embodiments of the present invention.

FIG. 5 shows a left side elevation view of an earless filter mask 100 in accordance with one or more embodiments of the present invention. From the left side elevation view, protruding portion 510 of mask 100 that may be configured to cover the wearer's nose and mouth (not shown) and first tapered end 520 of mask 100 are shown. The tapering down from protruding portion 510 to first tapered end 520 allows first tapered end 520 to be secured to the second tapered end (not shown) at the nape of the wearer's neck (not shown) below the wearer's ears (not shown) while still providing full coverage of the wearer's nose and mouth (not shown). The conforming band (150 of FIG. 2) disposed in upper in-seam sleeve 160*a* and lower in-seam sleeve 160*b* allows mask 100 to conform to the wearer's face (not shown).

Figure 6:
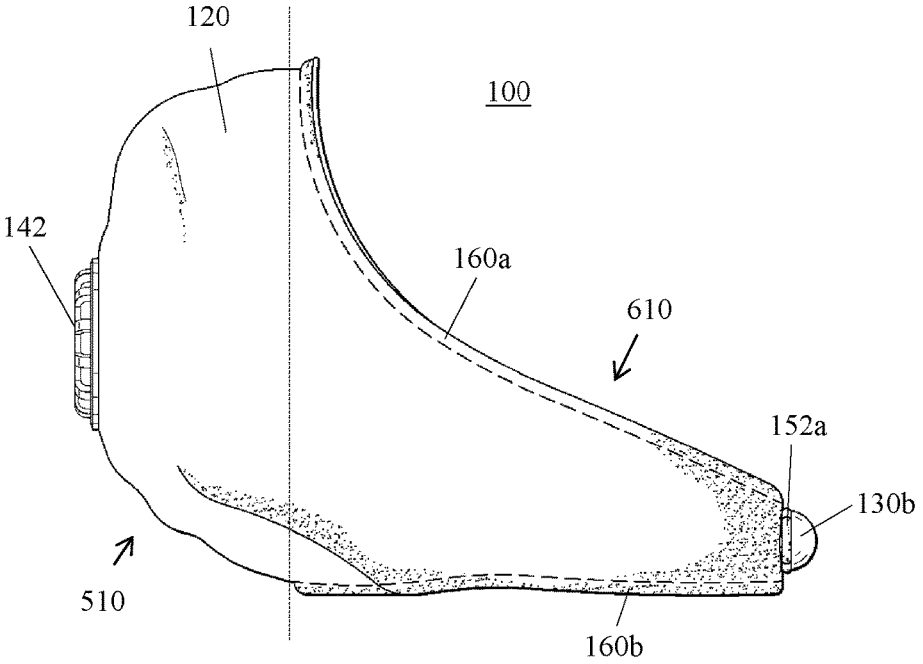
FIG. 6 shows a right side elevation view of an earless filter mask in accordance with one or more embodiments of the present invention.

FIG. 6 shows a right side elevation view of an earless filter mask 100 in accordance with one or more embodiments of the present invention. From the right side elevation view, protruding portion 510 of mask 100 and second tapered end 610 of mask 100 are shown. The tapering down from protruding portion 510 to second tapered end 610 allows the first tapered end (520 of FIG. 5) to be secured to second tapered end 610 at the nape of the wearer's neck (not shown) below the wearer's ears (not shown) while still providing full coverage of the wearer's nose and mouth (not shown). The conforming band (150 of FIG. 2) disposed in upper in-seam sleeve 160*a* and lower in-seam sleeve 160*b* allows mask 100 to conform to the wearer's face (not shown).

Figure 7:
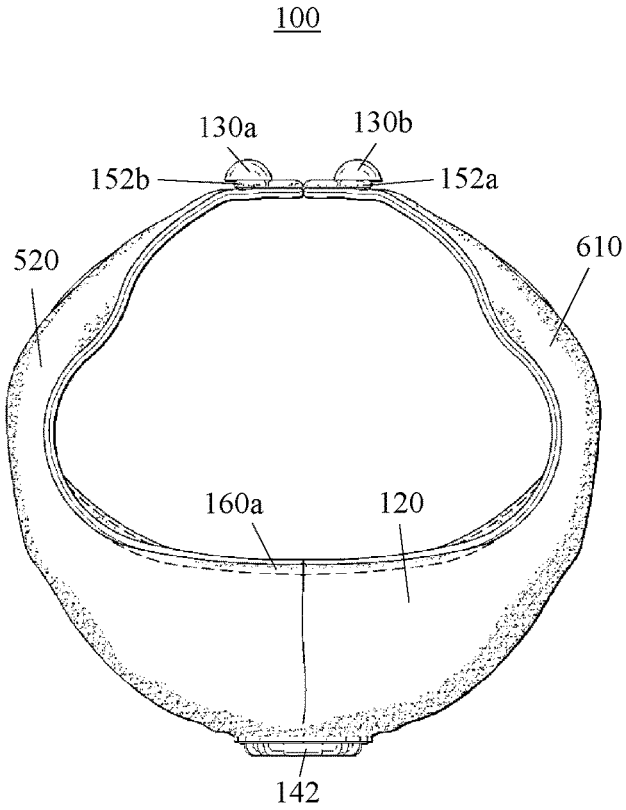
FIG. 7 shows a top plan view of an earless filter mask in accordance with one or more embodiments of the present invention.

FIG. 7 shows a top plan view of an earless filter mask 100 in accordance with one or more embodiments of the present invention. From the top plan view, first tapered end 520 is shown secured to second tapered end 610 as if a wearer (not shown) is wearing mask 100.

Figure 8:
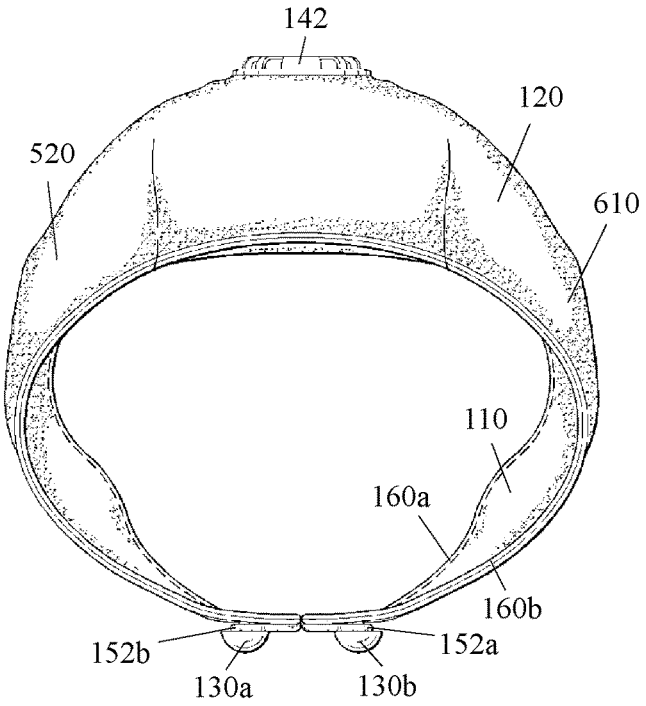
FIG. 8 shows a bottom plan view of an earless filter mask in accordance with one or more embodiments of the present invention.

FIG. 8 shows a bottom plan view of an earless filter mask 100 in accordance with one or more embodiments of the present invention. From the bottom plan view, first tapered end 520 is shown secured to second tapered end 610 as if a wearer (not shown) is wearing mask 100.

Figure 9:
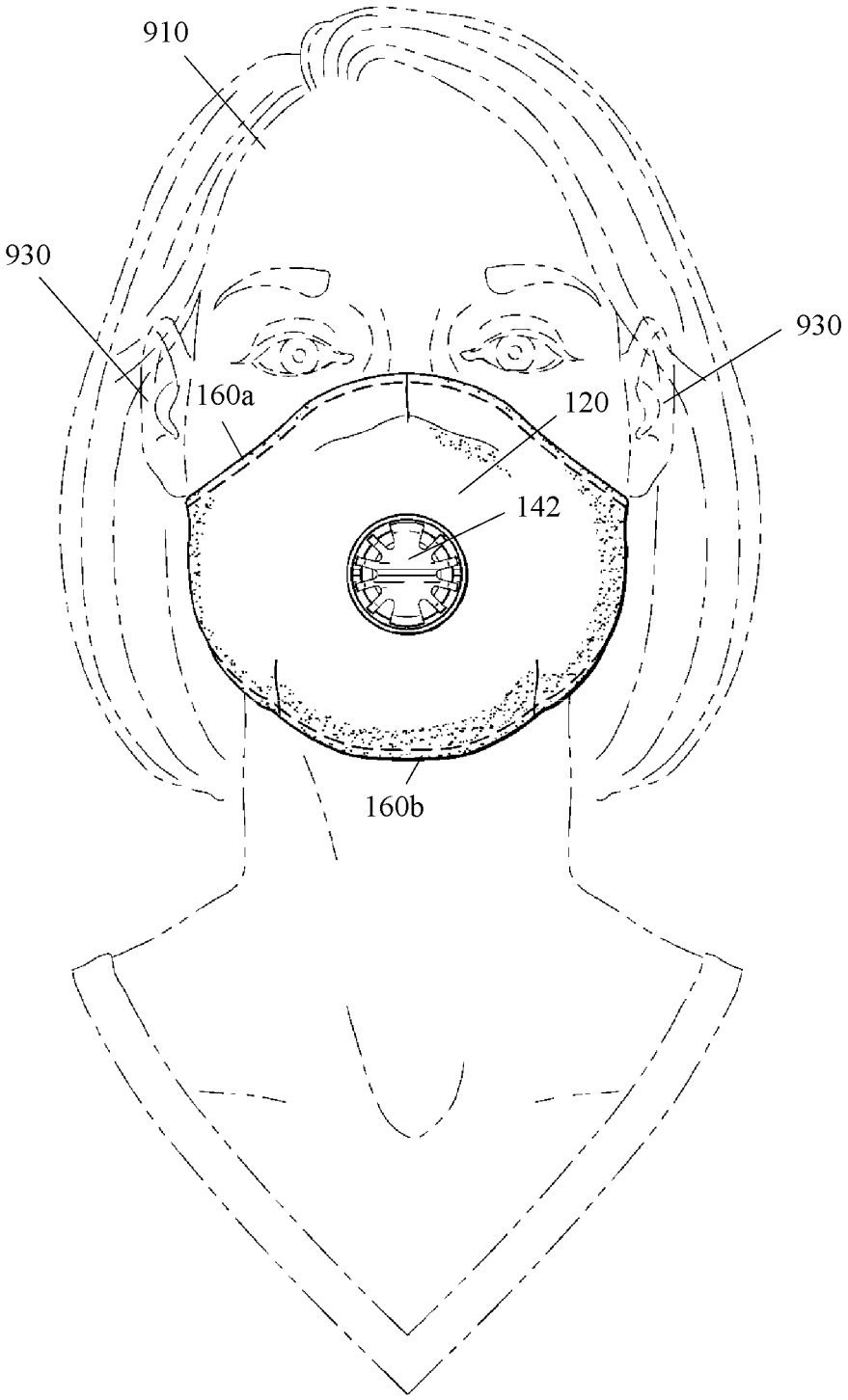
FIG. 9 shows a front elevation environmental view of an earless filter mask in accordance with one or more embodiments of the present invention.

FIG. 9 shows a front elevation environmental view of an earless filter mask 100 in accordance with one or more embodiments of the present invention. A method of filtering air with mask 100 may include placing earless filter mask 100 over a wearer's 910 nose and mouth (not independently illustrated). The method may also include conforming earless filter mask 100 to a shape of the wearer's 910 face. The wearer 910 may run a finger (not shown) along the conforming band (150 of FIG. 2) disposed in upper in-seam sleeve 160*a* and lower in-seam sleeve 160*b* of mask 100 to conform mask 100 to the shape of the wearer's 910 face. Because the conforming band (150 of FIG. 2) is disposed along the upper and the lower edges of mask 100, mask 100 forms a tight seal with the wearer's 910 face including the area from the bridge of the nose to the cheeks and the area along the bottom jawline of the wearer 910. As such, air may enter the mask through the outer fabric layer (120 of FIG. 2), is then filtered by the filter layer (115 of FIG. 2), and then traverses the inner fabric layer (110 of FIG. 2) such that the wearer may breathe the filtered air disposed within the interior breathing area of mask 100.

Figure 10:
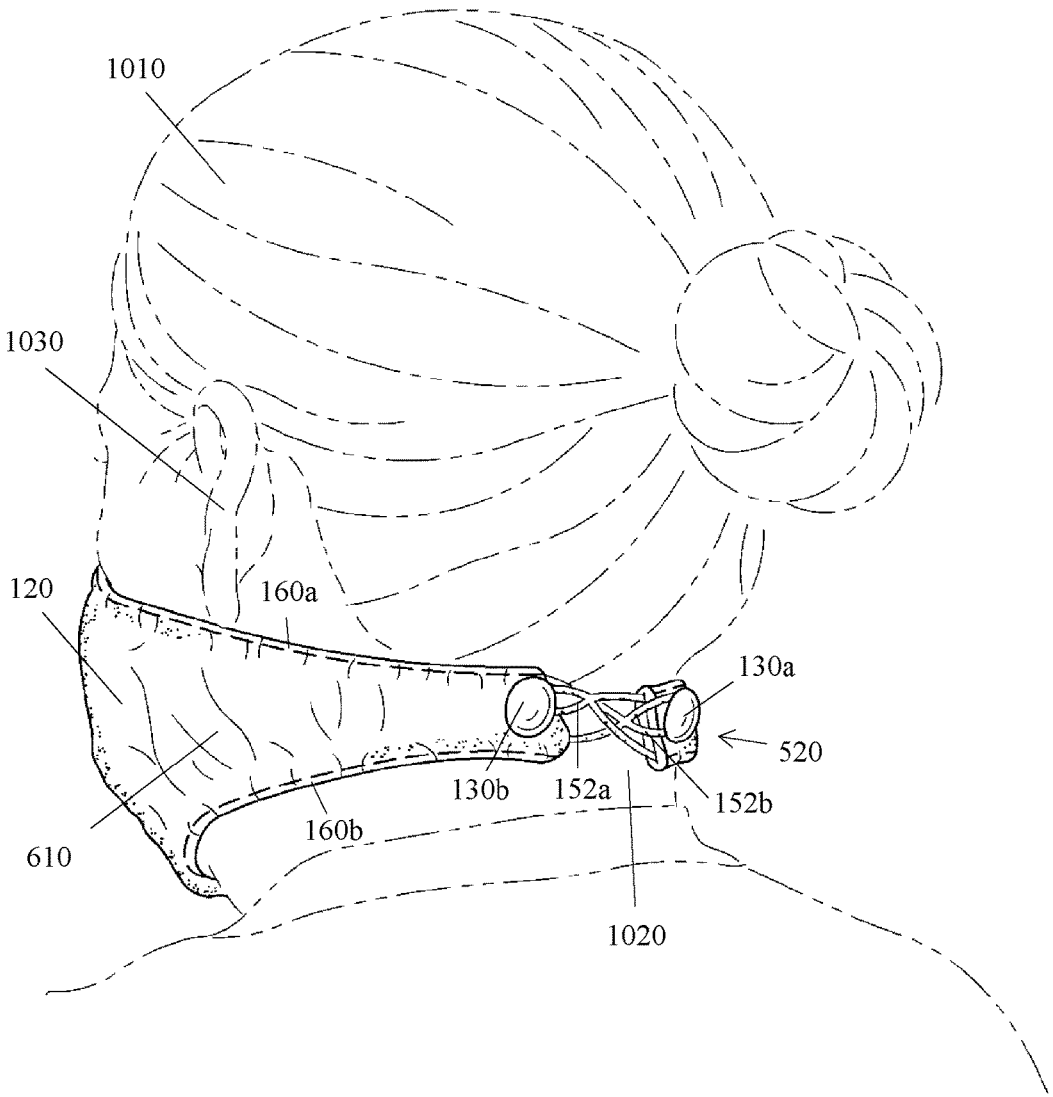
FIG. 10 shows a rear perspective environmental view of an earless filter mask in accordance with one or more embodiments of the present invention.

Continuing, FIG. 10 shows a rear perspective environmental view of an earless filter mask 100 in accordance with one or more embodiments of the present invention. The method may also include connecting a first tapered end 520 of mask 100 to a second tapered end 610 of mask 100 at the nape 1020 below the wearer's 1010 ears 1030. For example, wearer 1010 may pull a first loop (not independently illustrated) of first exposed portion 152*a* of the conforming band (150 of FIG. 2) that extends beyond the first tapered end 520 of mask 100 around button 130*b* disposed on the opposing tapered end 610 of mask 100. Similarly, wearer 1010 may pull a second loop (not independently illustrated) of second exposed portion 152*b* of the conforming band (150 of FIG. 2) that extends beyond the second tapered end 610 of mask 100 around button 130*a* disposed on the opposing tapered end 520 of mask 100, thereby securing mask 100 around the nape 1020 of the wearer's 1010 neck. First exposed portion 152*a* may include one or more loops, formed by twisting band 150, that may be used to connect to button 130*b* and second exposed portion 152*b* may include one or more loops, formed by twisting band 150, that may be used to connect to button 130*a*. One of ordinary skill in the art will recognize that the number of loops may vary to accommodate fit and size in accordance with one or more embodiments of the present invention.

Figure 11:
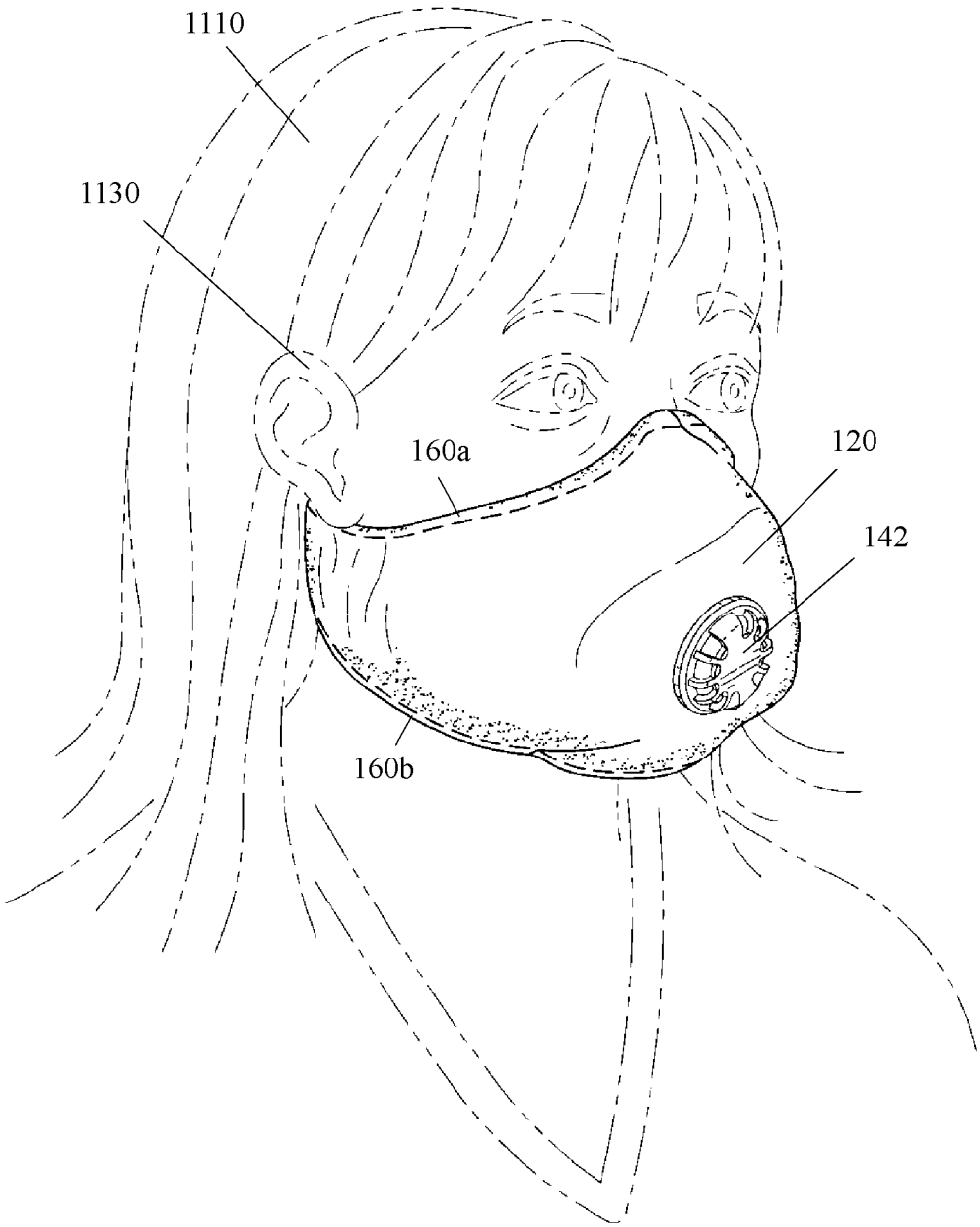
FIG. 11 shows a front perspective environmental view of an earless filter mask in accordance with one or more embodiments of the present invention.

FIG. 11 shows a front perspective environmental view of an earless filter mask 100 in accordance with one or more embodiments of the present invention. From the front perspective environmental view, wearer 1110 is shown wearing mask 100. Mask 100 in situ provides a small profile and is made of a soft breathable material that conforms to the shape of the wearer's 1110 face. Mask 100 may be comfortable to wear for extended periods of time, prevents the unintentional inhalation of polluted air, and is aesthetically pleasing. The filter layer (115 of FIG. 2) may prevent the inhalation of polluted air through the fabric layers of the mask, while remaining constructed of breathable material, and a single exhalation valve (portion 142 shown) may allow a wearer to breathe out while wearing the mask without the buildup of gases within the interior breathing area of the mask 100 or a warm sensation for the wearer 1110.

Advantages of one or more embodiments of the present invention may include one or more of the following:

In one or more embodiments of the present invention, an earless filter mask may include a multi-layer construction, including an interior filter layer, which wraps around and conforms to the shape of the wearer's face and tapers down in size to fasten at the nape of the wearer's neck below the ears. A conforming band may be sewn into the upper and the lower edges of the mask to conform the mask to the shape of the wearer's face and to secure each tapered end of the mask to a button disposed on the opposing tapered end of mask at the nape. The earless filter mask does not require attachment to the ears and promotes comfortable wear for extended periods of time.

In one or more embodiments of the present invention, an earless filter mask provides a unique shape that includes a conforming band on upper and lower edges of the mask that allow the mask to conform to a wearer's face. In addition to conforming along a front facing portion of the wearer's face, the mask conforms to the bottom and jawline of the wearer's face as the mask is pulled on and then secured around the nape of the neck.

In one or more embodiments of the present invention, an earless filter mask may include fabric layers made of soft and breathable material.

In one or more embodiments of the present invention, an earless filter mask may include a filter layer, disposed between the fabric layers, that prevents the unintentional inhalation of polluted air through the fabric layers.

In one or more embodiments of the present invention, an earless filter mask may include a conforming band that, in addition to being used to secure each tapered end of the mask to other tapered end, may be used to gather the fabric layers and conform the mask to the shape of the wearer's face.

In one or more embodiments of the present invention, an earless filter mask may include a single exhalation valve that allows a wearer to breathe out while wearing the mask, allows exhaled breath to escape without the buildup of gases within the interior facing portion of the mask, and minimizes moisture buildup inside the mask and the associated fogging up of eyewear.

In one or more embodiments of the present invention, an earless filter mask is comfortable to wear for extended periods of time.

In one or more embodiments of the present invention, an earless filter mask is aesthetically pleasing.

In one or more embodiments of the present invention, an earless filter mask may include a decorative layer disposed on an exterior facing portion of all or part of an outer fabric layer and one or more buttons.

In one or more embodiments of the present invention, an earless filter mask provides improved fit, improved comfort, and improved filtering while being aesthetically appealing.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An earless filter mask comprising:

an inner fabric layer;

a filter layer;

an outer fabric layer;

a plurality of buttons;

an exhalation valve; and a conforming band sewn into an upper and a lower edge of the mask through in-seam sleeves with a first exposed portion extending beyond a first tapered end of the mask and a second exposed portion extending beyond a second tapered end of the mask, wherein the conforming band is configured to conform the mask to a shape of a wearer's face and a first tapered end of the mask is configured to removably connect to a second tapered end of the mask at a nape of the wearer's neck.

2. The earless filter mask of claim 1, further comprising: a decorative layer.

3. The earless filter mask of claim 1, wherein the inner fabric layer comprises a cotton or cotton blend fabric material.

4. The earless filter mask of claim 1, wherein the filter layer comprises a carbon filter material.

5. The earless filter mask of claim 1, wherein the outer fabric layer comprises a cotton or cotton blend fabric material.

6. The earless filter mask of claim 2, wherein the decorative fabric layer comprises lace.

7. The earless filter mask of claim 1, wherein a first button of the plurality of buttons is disposed on an outer facing portion of a first tapered end of the outer fabric layer and a second button of the plurality of buttons is disposed on an outer facing portion of a second tapered end of the outer fabric layer.

8. The earless filter mask of claim 1, wherein the exhalation valve further comprises an outer facing portion disposed on an outer facing portion of the outer fabric layer.

9. The earless filter mask of claim 8, wherein the exhalation valve comprises an inner facing portion having a first distal end exposed on an interior facing portion of the inner fabric layer and a second distal end that extends through cutouts in the inner fabric layer, the filter layer, and the outer fabric layer and is removably attached to the outer facing portion of the exhalation valve with a valve flap disposed between the inner facing portion and the outer facing portion.

10. The earless filter mask of claim 9, wherein the valve flap comprises a rubber material.

11. The earless filter mask of claim 1, wherein the first exposed portion of the conforming band comprises a loop configured to connect to a button of the plurality of buttons and the second exposed portion of the conforming band comprises a loop configured to connect to a button of the plurality of buttons.

* * * * *